US006682241B2

(12) United States Patent
Coons et al.

(10) Patent No.: US 6,682,241 B2
(45) Date of Patent: Jan. 27, 2004

(54) THERMAL PRINTER WITH LOADING AID

(75) Inventors: David E. Coons, Webster, NY (US); Steven J. Sparer, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/080,139

(22) Filed: Feb. 21, 2002

(65) Prior Publication Data

US 2003/0156876 A1 Aug. 21, 2003

(51) Int. Cl.[7] ..... B41J 29/02; B41J 35/28

(52) U.S. Cl. ..... 400/692; 400/207; 400/208; 400/242; 400/693.1

(58) Field of Search ..... 400/206, 207, 400/208, 208.1, 242, 691, 692, 693, 693.1; 29/281.1

(56) References Cited

U.S. PATENT DOCUMENTS 4,475,830 A * 10/1984 Schaefer ..... 400/238
4,997,298 A * 3/1991 Uchimura et al. ..... 400/242
4,998,834 A * 3/1991 Taylor ..... 400/247
5,415,486 A * 5/1995 Wouters et al. ..... 400/692
5,440,328 A * 8/1995 Nardone et al. ..... 347/173
5,605,403 A * 2/1997 Vegeais et al. ..... 400/207

* cited by examiner

*Primary Examiner*—Daniel J. Colilla
*Assistant Examiner*—Jill E Culler
(74) *Attorney, Agent, or Firm*—Norman Rushefsky

(57) ABSTRACT

A method and apparatus of loading a thermal ribbon having dye into a cassette assembly of a thermal printer apparatus includes a cassette assembly for storing a thermal ribbon having dye. The thermal ribbon includes a supply ribbon core having a supply of the thermal ribbon wound thereon as a roll and a take-up ribbon core. The cassette assembly includes a supply ribbon support for supporting the supply ribbon core and a take-up ribbon support for supporting the take-up ribbon core. The cassette assembly is removed from the apparatus and then mounted upon a loading aid. The loading aid is mounted on the apparatus and supports the cassette assembly so that the cassette assembly extends outwardly of the printer apparatus to facilitate loading of the supply ribbon core and take-up ribbon core on the cassette assembly. A leader portion of the thermal ribbon extends from an outer convolution of the roll with a leading end portion of the leader portion being attached to the take-up ribbon core and a double sided tape being attached to the leader portion so as to adhesively couple the leader portion to the outer convolution of the roll.

16 Claims, 8 Drawing Sheets

THERMAL PRINTER WITH LOADING AID

BACKGROUND OF THE INVENTION

1. Field of the Invention

The present invention relates to apparatus and methods for loading dye ribbon into a cassette assembly for placement within a thermal printer and to a dye ribbon supply roll and take-up for use with said methods and apparatus.

2. Description Relative to the Prior Art

In a typical color thermal printer, the dye ribbon in the form of a web dye-carrier may contain one or more series of spaced frames of colored heat transferable dyes mounted on a supply core. In use in the thermal printer apparatus, the ribbon is unwound from the supply core and rewound upon a take-up core. The ribbon moves through a nip formed between a thermal print head and a dye-absorbing receiver sheet. The receiver sheet may, for example, be a coated paper and the print head is formed of a plurality of heating elements. When heat is selectively applied to the dye ribbon in response to image information provided to the print head causing selective enablement of heating elements, dye is selectively transferred to the receiver sheet through dye sublimation or dye diffusion.

In the prior art as represented by U.S. Pat. No. 5,415,486, it is noted that the dye ribbon is difficult to handle since it has typically a thickness in the order of magnitude of ten micrometers only. For this reason, it is generally known to provide a factory loaded cassette having the supply and take-up cores already mounted and which may be directly mounted into the machine without manipulation by an operator of the printer apparatus. However, the factory mounted cassette must be disposed of or returned to the factory. In the approach suggested by the aforementioned U.S. patent a special package may be provided that can be used to mount the supply and take-up cores into a reloadable cassette. In this approach the package and the cassette are placed on a table and the respective supply and take-up cores are transferred in a particular series. A problem with this approach is the requirement of the special packaging.

It is therefore an object of the invention to improve upon the mounting of rolls of thermal dye ribbon into a cassette assembly.

SUMMARY OF THE INVENTION

In accordance with a first aspect of the invention, there is provided a thermal printer apparatus comprising a cassette assembly for storing a thermal ribbon having dye, the thermal ribbon including a supply ribbon core and a take-up ribbon core, the cassette assembly including a supply ribbon support for supporting the supply ribbon core and a take-up ribbon support for supporting the take-up ribbon core, the cassette assembly being removable from the apparatus; a thermal print head positionable in engagement with the thermal ribbon for transferring dye from the thermal ribbon to a receiver sheet; a loading aid coupled to the printer apparatus and having structure for supporting the cassette assembly after the cassette assembly is removed from the apparatus, the loading aid supporting the cassette assembly so that the cassette assembly extends outwardly of the printer apparatus to facilitate loading of the supply ribbon core and take-up ribbon core in the cassette assembly.

In accordance with a second aspect of the invention, there is provided a method of loading a thermal ribbon having dye into a cassette assembly of a thermal printer apparatus, the method comprising providing a cassette assembly for storing a thermal ribbon having dye, the thermal ribbon including a supply ribbon core having a supply of the thermal ribbon wound thereon as a roll and a take-up ribbon core, the cassette assembly including a supply ribbon support for supporting the supply ribbon core and a take-up ribbon support for supporting the take-up ribbon core, the cassette assembly being removable from the apparatus; removing the cassette assembly from the apparatus; mounting the cassette assembly after the cassette assembly is removed from the apparatus upon a loading aid, the loading aid supporting the cassette assembly so that the cassette assembly extends outwardly of the printer apparatus to facilitate loading of the supply ribbon core and take-up ribbon core in the cassette assembly; and positioning the supply ribbon core and take-up ribbon core respectively upon the supply ribbon support and the take-up ribbon support of the cassette assembly.

In accordance with a third aspect of the invention, there is provided a thermal ribbon supply and take-up for loading into a cassette assembly of a thermal printer apparatus, the ribbon supply and take-up comprising a supply core having a supply of thermal ribbon wound thereon as a roll and a take-up core,wherein the thermal ribbon includes a leader portion formed of the thermal ribbon, that extends from an outer convolution of the roll of thermal ribbon with a leading end portion of the leader portion being attached to the take-up ribbon core and a double sided tape being attached to the leader portion so as to adhesively couple the leader portion to the outer convolution of the roll and wherein the adhesive coupling is sufficiently strong so as to prevent unraveling of the thermal ribbon from the roll on the supply core when the take-up core is supported by an operator and the supply core with the complete roll of ribbon thereon except for the leader portion, is allowed to dangle freely.

BRIEF DESCRIPTION OF THE DRAWINGS

The invention will be described hereinafter by way of example with reference to the accompanying drawings wherein.

DESCRIPTION OF THE PREFERRED EMBODIMENTS

The invention will be described with reference to a single pass, multi-color thermal printer of the type described in U.S. Pat. No. 5,440,328. In such a printer a print engine is provided that comprises a media transport system and three or more thermal print head assemblies or print stations. Each of the print head assemblies includes a respective re-loadable thermal ribbon cassette which is loaded with a color transfer ribbon. Each of the thermal print head assemblies comprises a cantilevered beam, a mounting assembly and a thermal print head having a thermal print line. Each of the print head assemblies has a counterpart platen roller with which a respective print head forms a respective nip and through which the media passes in combination with a respective color ribbon of dye. The mounting assemblies allow the print heads positions to be adjusted so that the mounting assemblies can be pivoted towards and away from the respective platen rollers. In this regard, the mounting assemblies are pivotable between an "up" position wherein the print heads are disengaged from the platen rollers and a "down" position wherein the print heads are in biased engagement with the platen rollers.

The reloadable ribbon cassette assembly comprises a cassette body including a ribbon supply roll and a ribbon take-up roll. The ribbon cassette assemblies are loaded with one of three or more primary color ribbons which are used in conventional subtractive color printing. The supply and take-up rolls of each ribbon cassette assembly are coupled to individual ribbon drive sub-assemblies when the cassette assembly is loaded into the printer for printing images on the media. In addition to an assembly for each of the color ribbons there may also be provided a ribbon cassette assembly that is provided with a supply of transparent ribbon that can transfer an overcoat layer to the media after an image has been printed thereon. The transparent ribbon cassette assembly is similar in all respects to the other assemblies and a separate print head is used to transfer the overcoat layer to the now imaged receiver. Different types of transparent ribbon may be used to provide met or glossy finish overcoats to the final print. Alternatively, the print head associated with the transparent ribbon may have the respective recording elements suitably modulated to create different finish overcoats to the final print.

Figure 1:
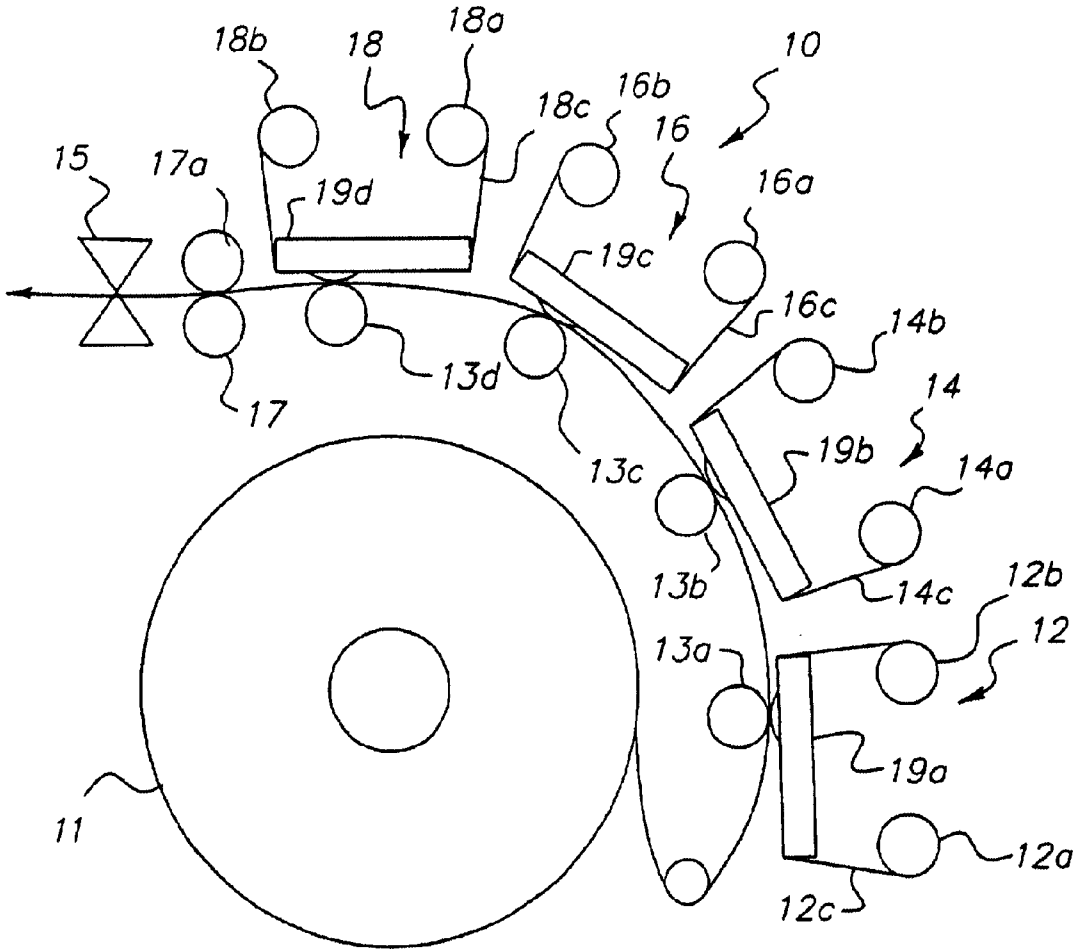
FIG. 1 is a schematic side elevational view of a thermal print engine for use with the invention.

Referring now to the drawings there is illustrated in FIG. 1 a single-pass multicolor thermal print engine 10 that may be used in accordance with the teachings of the instant invention. A receiver media 11 comprising coated paper having a coating thereon for receiving a thermal dye is supported as a continuous roll and threaded about a series of platen rollers 13*a–d*. The receiver media is also threaded through a nip comprised of a capstan drive roller 17 and a backup roller. As the receiver media is driven by the capstan drive roller the receiver media passes by each thermal print assembly 12, 14, and 16 a respective color dye image is transferred to the receiver sheet to form the multicolor image. For example the assembly 12 may provide a yellow color separation image, the assembly 14 may provide a magenta color separation image, and the assembly 16 may provide a cyan color separation image to form a three color multicolor image on the receiver sheet. A fourth assembly 18 is provided for thermally transferring the transparent overcoat to protect the color image from for example fingerprints. At each of the four assemblies there is provided a thermal print head 19*a–d* that has recording elements selectively enabled in accordance with image information to selectively transfer color dye to the receiver or in the case of the transparent ribbon to transfer the overcoat layer to the now imaged receiver sheet. After each multicolor image is formed, a cutter 15 may be enabled to cut the receiver media into a discrete sheet containing the multicolor image protected by the transparent overcoat layer. As may be seen in FIG. 1 at each thermal print assembly, there is provided a platen roller which forms a respective printing nip with the respective print head 19*a–d*. As the receiver sheet is driven through each of the respective nips, the movement of the receiver sheet advances a corresponding thermal ribbon 12*c*, 14*c*, 16*c* and 18*c* through the respective nip as well. Each thermal ribbon is mounted upon a respective cassette assembly which will be described below and comprises a supply roll (12*a*, 14*a*, 16*a* and 18*a*) and a take-up roll (12*b*, 14*b*, 16*b* and 18*b*).

Figure 2:
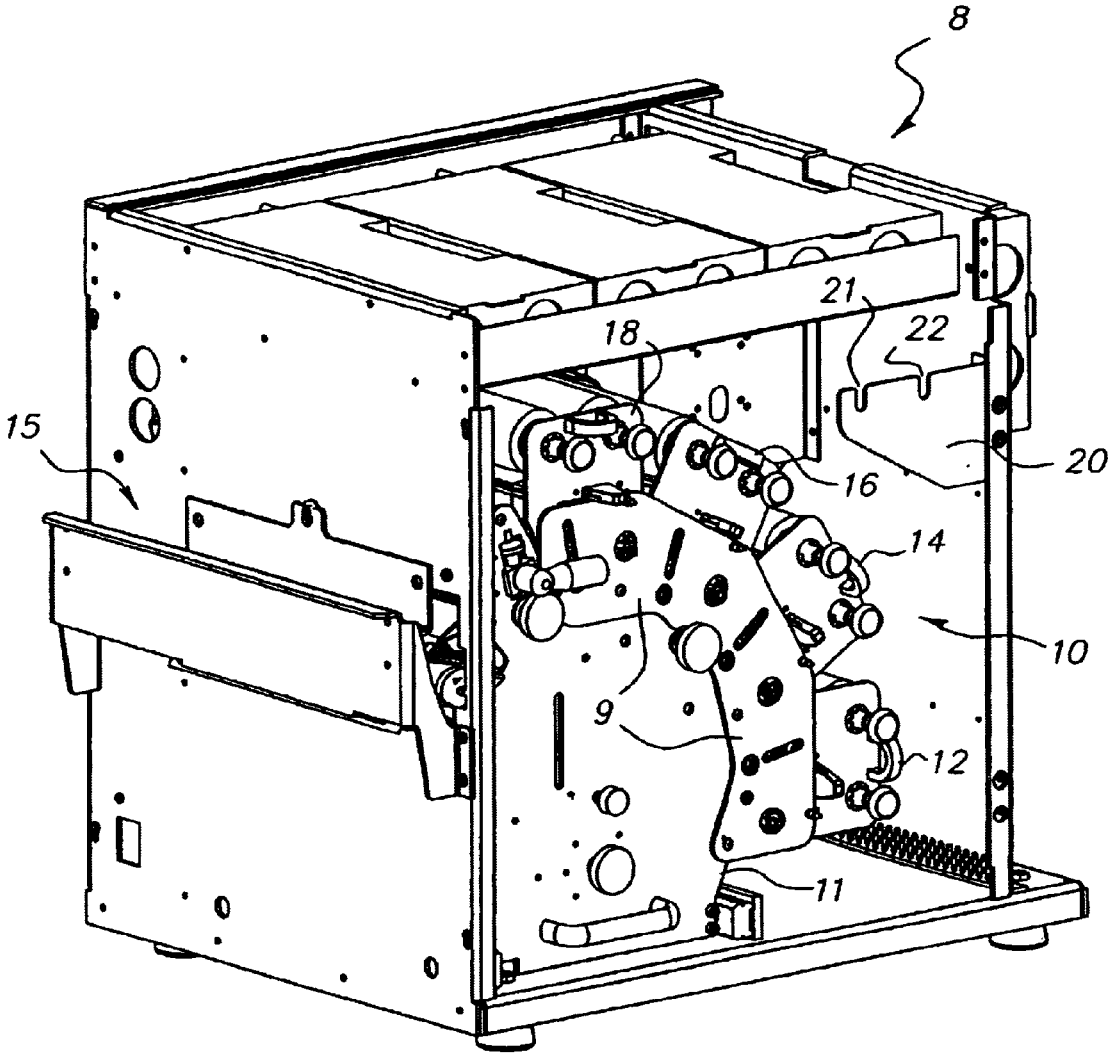
FIG. 2 is a perspective view of a thermal printer that employs the thermal print engine of FIG. 1 and illustrates a loading aid associated with the thermal printer for facilitating loading of supply and take-up ribbon cores onto thermal ribbon cassette assemblies.

With reference now to FIG. 2, there is shown a printer apparatus 8 that includes a housing which encloses the printer engine 10 illustrated in FIG. 1. A front housing door has been removed to illustrate the inside of the printer apparatus so that the various thermal print assemblies 12, 14, 16, and 18 may be seen. A decorative outer housing is also not shown. Supported on one of the sidewalls of the housing so as to be presented at the front opening when the front housing door (not shown) is swung open is a loading aid bracket. As may be noted from FIG. 2, the loading aid bracket comprises a vertically upstanding plate 20 that includes two vertical slots 21, 22 formed in a top edge of the plate.

Figure 3:
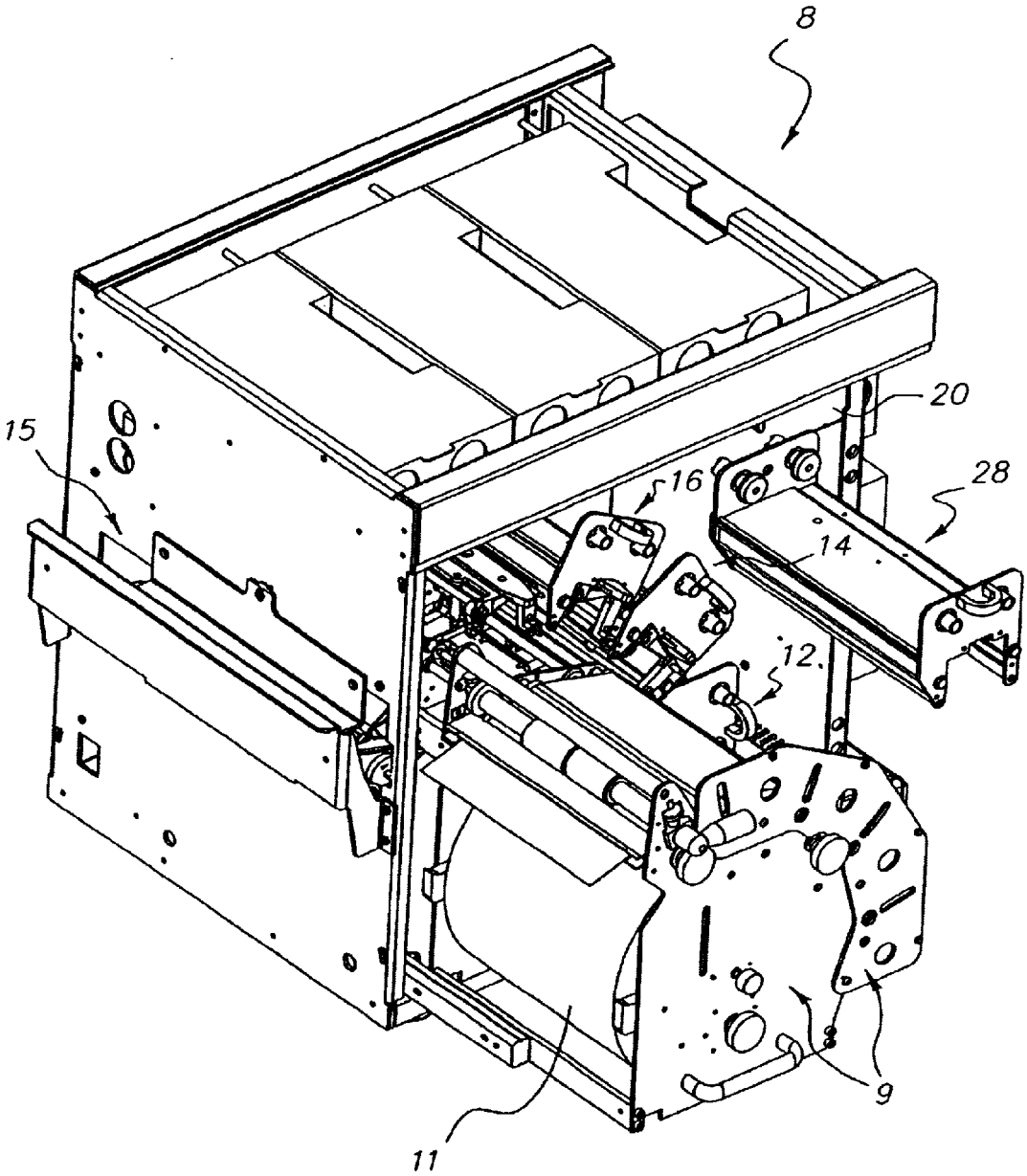
FIG. 3 is a view similar to that of FIG. 2, but illustrating a thermal ribbon cassette assembly removed from its position in a print station of the printer and mounted on a loading aid.
Figure 4:
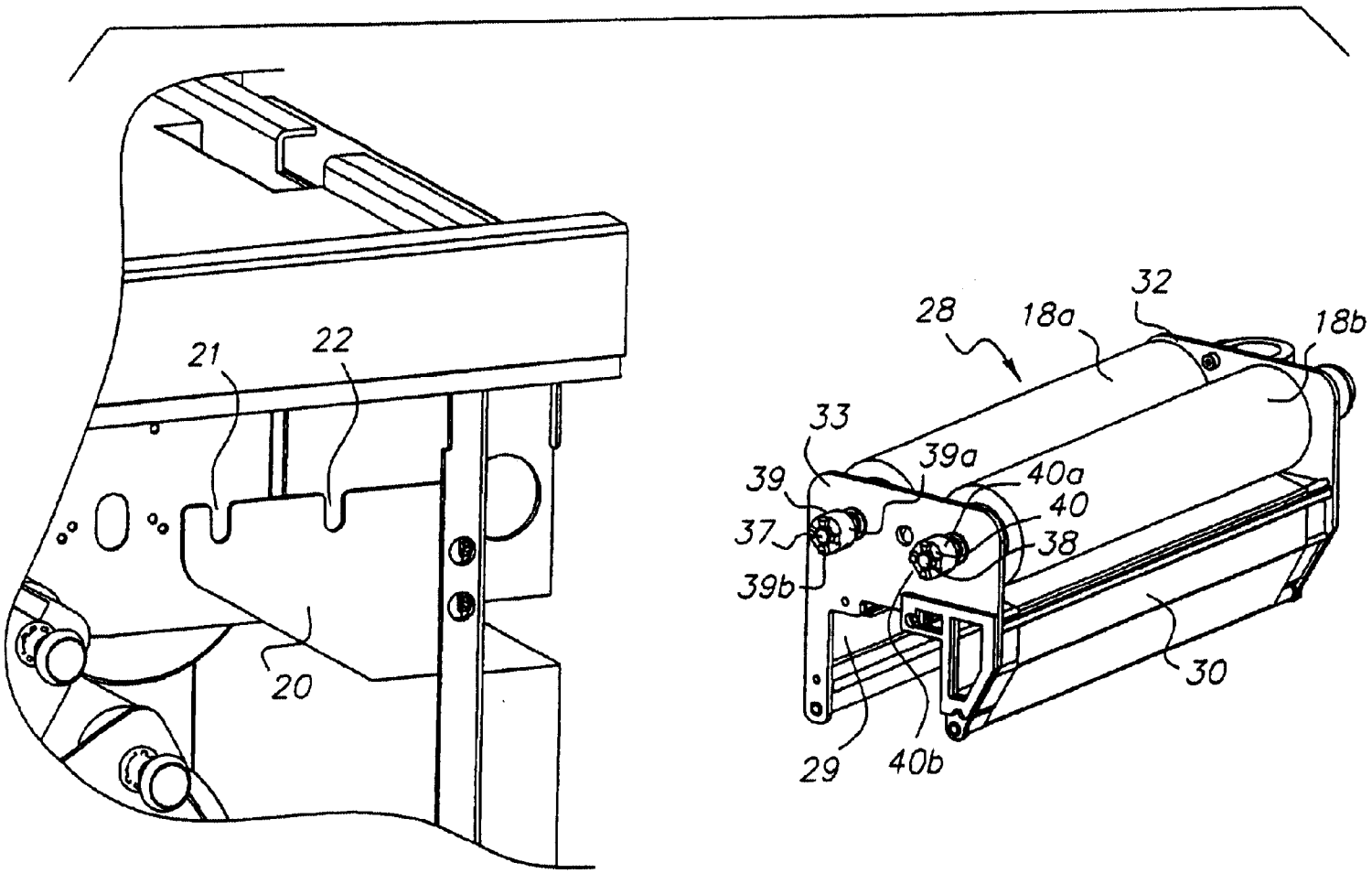
FIG. 4 is a close-up view in perspective of the loading aid and a thermal ribbon cassette assembly.
Figure 6:
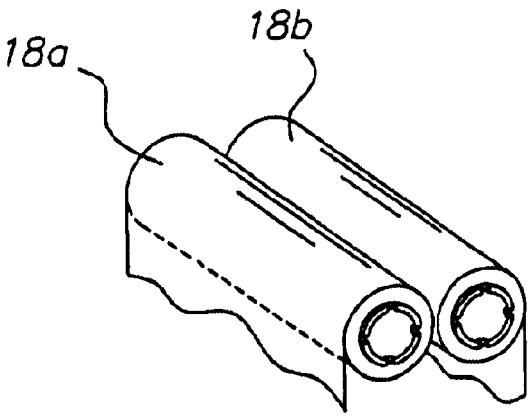
FIG. 6 is a view of the rear end of each of the supply and take-up rolls showing the respective cores with notches.

With reference now to FIG. 3, there is shown a view similar to that of FIG. 2 except that a reloadable ribbon cassette assembly 28 forming a part of one of the thermal print assemblies has been slid forward on a sliding rail and removed from the printer apparatus. In order for the ribbon cassette assembly to be moved forwardly, a platen assembly 9, which includes the support for the roll 11 of paper media and all the drive components for the paper media including platen rollers and capstan roller, is moved forwardly to provide room for sliding movement of any of the ribbon cassette assemblies. With reference now to FIG. 4, there is shown a rear view of the ribbon cassette assembly 28 removed from the printer apparatus and a close-up view of the loading aid bracket 20 that is bolted or welded to the frame of the printer apparatus. The ribbon cassette assembly includes a central extrusion of aluminum having depending right and left sidewalls 29,30 and front and back walls 32,33 that are attached to the aluminum extrusion. In the view of FIG. 4, it may be seen that the supply and take-up rolls 18*a*, 18*b* for this particular ribbon are supported on the ribbon cassette assembly. While not shown in FIG. 4 the ribbon would extend from the supply roll 18*a* around the right and left depending sidewalls 29,30 and up to the take-up roll 18*b*. The ribbon cassette assembly includes appropriate supports 35*f*,35*r*,36*f*,36*r* (see also FIG. 7) for supporting each of the supply and take-up rolls on respective supports at the front and back ends thereof. In this regard, each of the supply and take-up rolls may include a core upon which the ribbon material is adapted to be wound. The supports for the respective cores may comprise insert devices each of which engage a respective end of each core and support the core for rotation at that end. The insert devices in the rear may have pins or projections as shown to engage with mating slots formed at the rear end of each of the cores to allow drive of the cores. Such insert devices are well-known in the art. At the rearward end of the ribbon cassette assembly, the insert devices at the rear end are each attached, through a respective shaft 37,38 that extends through respective openings in the backwall 33 and are respectively coupled to respective gears 39, 40. The gears comprise base members 39*a*, 40*a* that have four teeth 39*b*, 40*b* axially projecting therefrom. A space is provided between the base member 39*a*, 40*a* and the backwall 33 that is sufficient to permit mounting of the shafts 37,38 in the respective slots 21,22 on the loading aid bracket 20.

Figure 5:
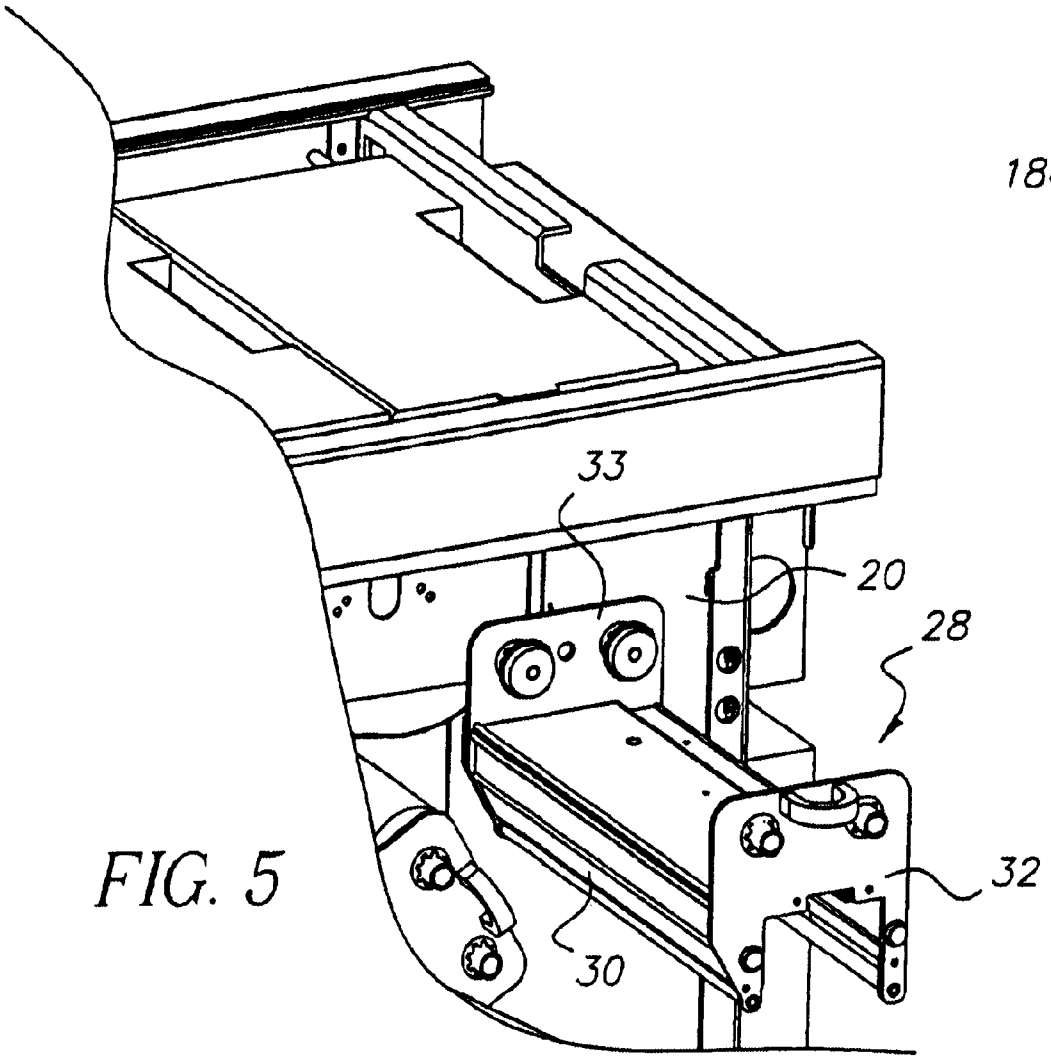
FIG. 5 is a close-up view of the loading aid and illustrating the thermal ribbon cassette assembly mounted on the loading aid.
Figure 7:
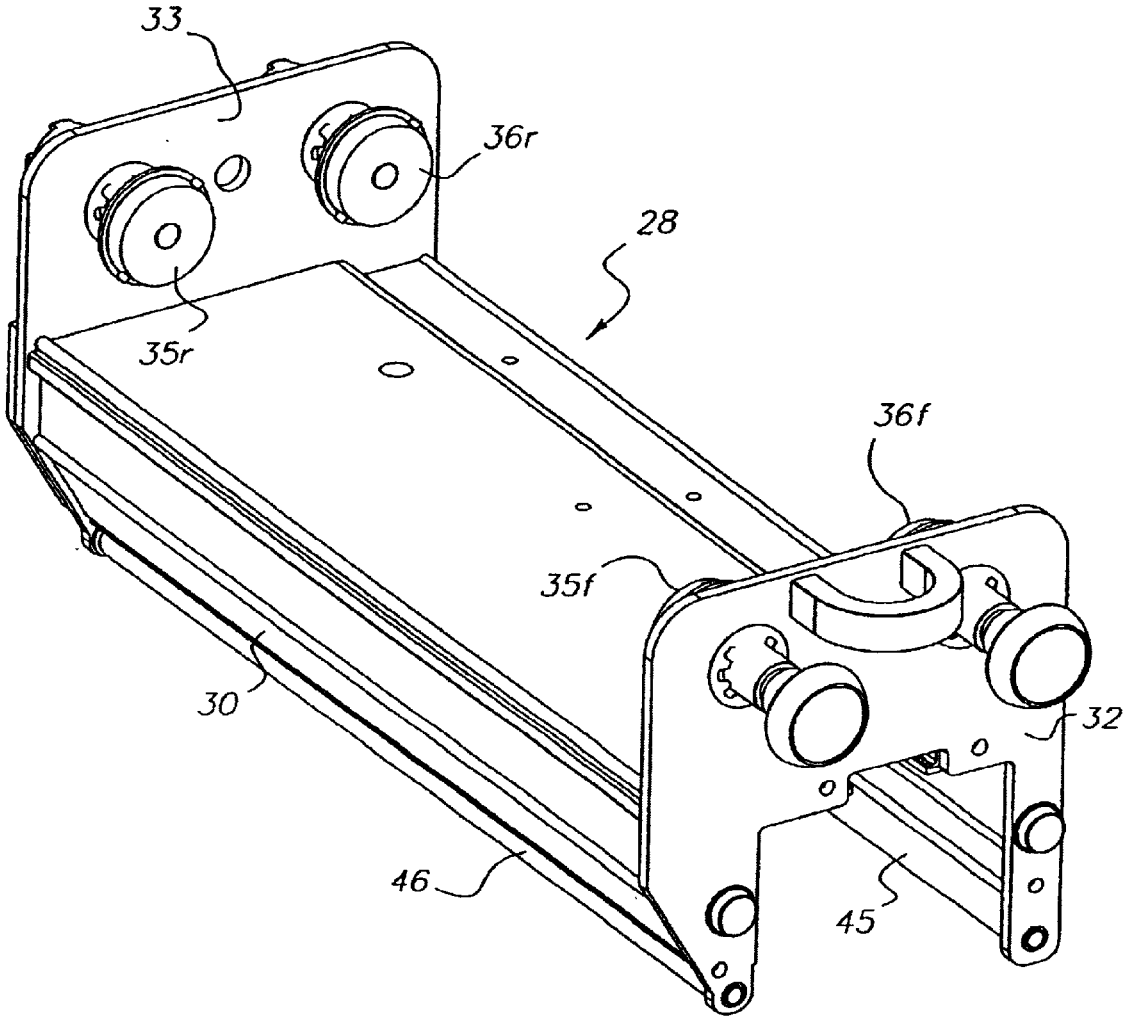
FIGS. 7 and 8 are different perspective views of the thermal ribbon cassette assembly.
Figure 8:
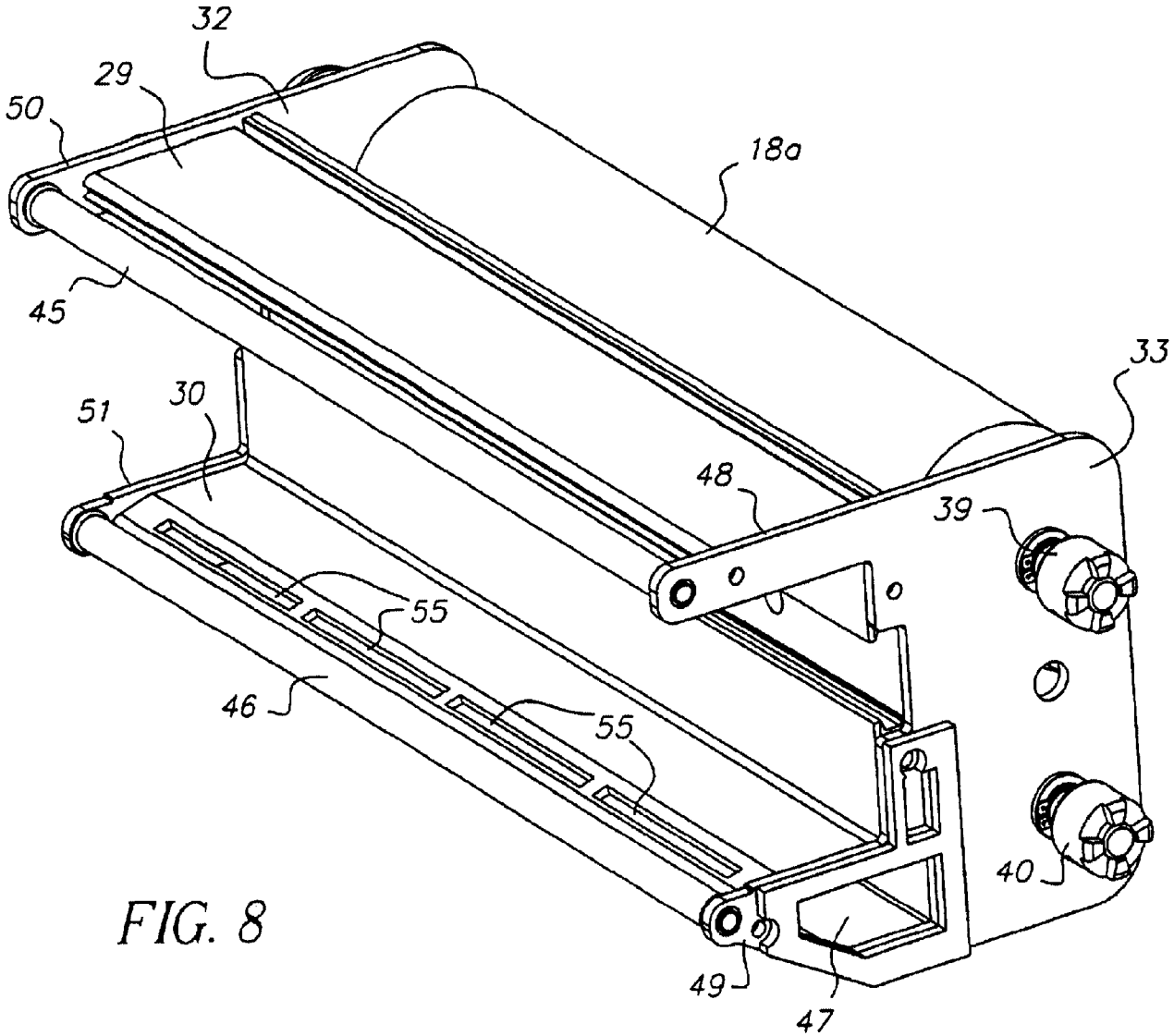

With reference now to FIGS. 3 and 5, there is shown the ribbon cassette assembly 28 mounted to the loading aid bracket 20. In FIG. 5, there is shown a close-up view of the ribbon cassette assembly 28 mounted on the loading aid bracket 20 with the supply and take-up rolls removed and ready to receive a new supply roll and take-up roll. In FIG. 7, the insert devices are shown in the form of gudgeons 35*r*, 35*f*, 36*r*, 36*f* that are spring-loaded to be received within the respective end of each core. With reference now to FIG. 8, still another view of the ribbon cassette assembly is shown and illustrating more clearly additional structures such as guide rollers 45, 46 about which the thermal ribbon is wrapped. The guide rollers 45, 46 are supported for rotation in respective openings in the depending legs 48, 49 associated with the rear plate 33 and depending legs 50, 51 associated with the front plate 32. Formed within the left sidewall 30 is a plenum chamber 47 into which air may be blown from a fan in the printer apparatus to distribute air to the respective print head associated with the ribbon cassette assembly. The air in the plenum exits from openings 55 in the wall 30 to impinge upon heat sinks associated with the print head.

Figure 9:
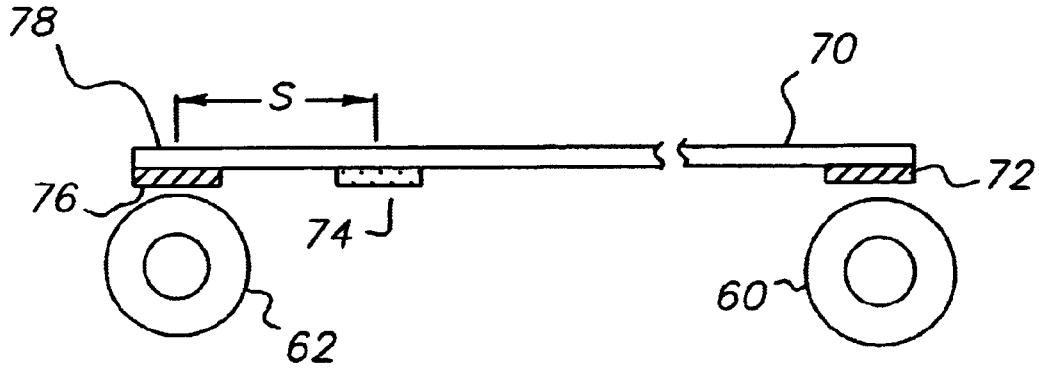
FIG. 9 is a schematic view showing parts of the ribbon take-up and supply rolls.
Figure 10:
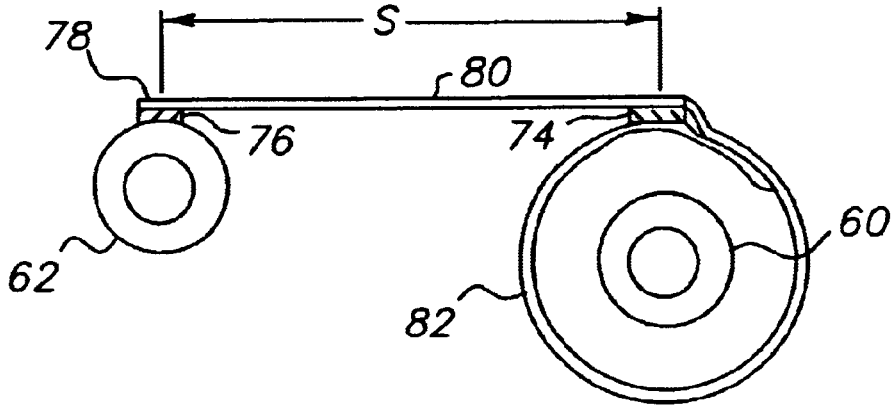
FIG. 10 is another schematic view showing the ribbon take-up and supply rolls.

With reference now to FIGS. 9 and 10, the supply and take-up rolls comprise respective cores 60, 62 for supporting the respective ribbon rolls. The supply includes a leader portion 80 that extends from an outer convolution 82 of the supply roll of thermal ribbon with a leading end portion 78 of the leader portion being attached to the take-up ribbon core 62 using a double sided tape that is of the "permanent" tied. A double sided tape piece 74 is attached to the leader portion 80 at a sufficient distance from the leading end portion 78 so as to adhesively couple the leader portion 80 to the outer convolution 82 of the take-up roll. The tape piece 74 is of the "removable" type so that the adhesive coupling between the outer convolution of the take-up roll and the leader portion is sufficiently strong so as to prevent unraveling of the thermal ribbon from the roll on the supply core when the take-up core is supported by an operator and the supply core with the complete roll of ribbon around thereon (but for the leader portion 80) is allowed to dangle freely. This could happen inadvertently where the operator, while holding the take-up core, drops the supply roll but there is no unwinding thereof due to the adhesive connection by the tape piece 74 to the leader portion and the outer convolution. It will be appreciated that the leader portion 80, including the leading end portion 78, is comprised of the ribbon material itself and this simplifies packaging of the thermal print of the ribbon by not requiring any leader to be attached to the ribbon to assist in mounting of the ribbon rolls to the ribbon cassette assembly. It will be understood that the terms permanent type tape and removable type tape are relative terms with regard to their particular functions, however it will be well understood that the permanent type tape makes sufficient engagement with the take-up core as to make it unlikely during normal use that there will be any separation between the leading end portion 78 and the take-up core 62 when they are joined by the tape piece 76. On the other hand it is expected that there will be separation between the outer convolution 82 of the supply roll and tape piece 74 when the operator desires to break the adhesive connection in the process of mounting the cores upon the ribbon cassette assembly. A permanent type tape piece 72 may also be attached to the trailing end of the thermal ribbon to securely attached the terminal end of the thermal print ribbon to the supply core 60.

With the cassette ribbon assembly 28 mounted and thus supported on the loading aid bracket 20, both hands of the operator are free to obtain the supply roll with the take-up core having the leading end portion of the ribbon attached thereto and to now mount the supply roll to the cassette ribbon assembly by urging one of the spring-loaded supply roll supporting devices 36*r*,36*f* rearwardly in the case of the rear support device or forwardly in case of the front support device so that the supply core may be received by these supports through spring bias upon the support devices being freed to move axially towards the core.

Although the leader portion 80 of the ribbon is attached to the outer convolution of the take-up roll by the double sided adhesive tape 74, the operator may relatively easily undo this adhesive attachment and wrap the ribbon about the right sidewall 29 and then the left sidewall 30 so that the take-up core is now in position to be mounted on the cassette ribbon assembly. The adhesive connection of the leading end 78 to the take-up core 62 is substantially greater than the adhesive connection of the double sided tape 74 to the outer convolution so that there is no danger of adhesion being lost between the leading end 78 and the take-up core 62 during mounting of the take-up and supply cores to the ribbon cassette assembly. The take-up roll supporting devices 35*r*, 35*f* are similarly constructed and spring-biased as that of the supply roll supporting devices to receive the take-up core. It is preferred to have the tape piece 74 located relative to the leading end portion 78 so that, when the ribbon cassette assembly with the newly inserted take-up and supply cores mounted thereto are input back into the printer apparatus, the tape piece 74 is positioned downstream of the print nip where the printer would engage the thermal ribbon so that the tape piece 74 does not contaminate or engage the receiver sheet or receiver media. The spacing S of about 3.5 inches is suitable in the example provided herein. The ribbon cassette assembly may now be removed from the loading aid bracket and then supported on the appropriate rails for sliding placement within the printer apparatus. In this regard, as is known, the ribbon cassette assembly may be provided with dovetail structure that engages the rails for the sliding movement. The platen assembly 9 is then retracted into its operative position for commencement of printing.

The invention has been described in detail with particular reference to preferred embodiments thereof, but it will be understood that variations and modifications may be made in accordance with the spirit and scope of the invention.

What is claimed is:

1. A thermal printer apparatus comprising:

a cassette assembly for storing a thermal ribbon having dye, the thermal ribbon including a supply ribbon core and a take-up ribbon core, the cassette assembly including a supply ribbon support for supporting the supply ribbon core and a take-up ribbon support for supporting the take-up ribbon core, the cassette assembly being removable from the apparatus;

a thermal print head positionable in engagement with the thermal ribbon for transferring dye from the thermal ribbon to a receiver sheet;

a loading aid coupled to the printer apparatus and having structure for supporting the cassette assembly after the cassette assembly is removed from the apparatus, the loading aid supporting the cassette assembly so that the cassette assembly extends outwardly of the printer apparatus to facilitate loading of the supply ribbon core and take-up ribbon core in the cassette assembly.

2. The apparatus of claim 1 and wherein the loading aid comprises a bracket including a first slot for receiving the supply ribbon support of the cassette assembly and a second slot for receiving the take-up ribbon support of the cassette assembly.

3. The apparatus of claim 2 and wherein the take-up ribbon support includes a gear member coupled to a shaft and the shaft is located within the second slot.

4. The apparatus of claim 3 and wherein the cassette assembly includes right and left side walls and the ribbon is wound about the right and left side walls.

5. A thermal printer apparatus comprising:

a cassette assembly for storing a thermal ribbon having dye, the thermal ribbon including a supply ribbon core and a take-up ribbon core, the cassette assembly including a supply ribbon support for supporting the supply ribbon core and a take-up ribbon support for supporting the take-up ribbon core, the cassette assembly being removable from the apparatus;

a thermal print head positionable in engagement with the thermal ribbon for transferring dye from the thermal ribbon to a receiver sheet;

a loading aid means coupled to the printer apparatus for supporting the cassette assembly after the cassette assembly is removed from the apparatus, the loading aid means supporting the cassette assembly so that the cassette assembly extends outwardly of the printer apparatus to facilitate loading of the supply ribbon core and take-up ribbon core in the cassette assembly.

6. A method of loading a thermal ribbon having dye into a cassette assembly of a thermal printer apparatus, the method comprising:

providing a cassette assembly for storing a thermal ribbon having dye, the thermal ribbon including a supply ribbon core having a supply of the thermal ribbon wound thereon as a roll and a take-up ribbon core, the cassette assembly including a supply ribbon support for supporting the supply ribbon core and a take-up ribbon support for supporting the take-up ribbon core, the cassette assembly being removable from the apparatus;

removing the cassette assembly from the apparatus;

mounting the cassette assembly after the cassette assembly is removed from the apparatus upon a loading aid, the loading aid supporting the cassette assembly so that the cassette assembly extends outwardly of the printer apparatus to facilitate loading of the supply ribbon core and take-up ribbon core in the cassette assembly; and positioning the supply ribbon core and take-up ribbon core respectively upon the supply ribbon support and the take-up ribbon support of the cassette assembly.

7. The method of claim 6 and including wrapping the ribbon about right and left side walls of the cassette assembly so that a portion of the ribbon is in position to be engaged by a thermal print head during operation of printing by the thermal printer apparatus.

8. The method of claim 7 and wherein the loading aid includes first and second slots and the supply ribbon support is mounted in the first slot and take-up ribbon support is mounted in the second slot.

9. The method of claim 8 and wherein the thermal ribbon includes a leader portion that extends from an outer convolution of the roll of thermal ribbon with a leading end portion of the leader portion being attached to the take-up ribbon core and a double sided tape being attached to the leader portion so as to adhesively couple the leader portion to the outer convolution of the roll and wherein the adhesive coupling is sufficiently strong so as to prevent unraveling of the thermal ribbon from the roll on the supply core when the take-up core is supported by an operator and the supply core with the roll of ribbon thereon is allowed to dangle freely.

10. The method of claim 9 and wherein the double sided tape is located relative to the leader portion at a location from the leading end of the leader portion so that when the supply core and take-up core are mounted on the cassette assembly with the thermal ribbon wound about the cassette assembly and the cassette assembly is supported in the printer apparatus the double sided tape is positioned downstream of a print nip where the printer would engage the thermal ribbon so that the double sided tape does not engage receiver media during printing.

11. The method of claim 7 and wherein the thermal ribbon includes a leader portion that extends from an outer convolution of the roll of thermal ribbon with a leading end portion of the leader portion being attached to the take-up ribbon core and a double sided tape being attached to the leader portion so as to adhesively couple the leader portion to the outer convolution of the roll and wherein the adhesive coupling is sufficiently strong so as to prevent unraveling of the thermal ribbon from the roll on the supply core when the take-up core is supported by an operator and the supply core with the roll of ribbon thereon is allowed to dangle freely.

12. The method of claim 11 and wherein the double sided tape is located relative to the leader portion at a location from a leading end of the leader portion so that when the supply core and take-up core are mounted on the cassette assembly with the thermal ribbon wound about the cassette assembly and the cassette assembly is supported in the printer apparatus the double sided tape is positioned downstream of a print nip where the printer would engage the thermal ribbon so that the double sided tape does not engage receiver media during printing.

13. The method of claim 6 and wherein the thermal ribbon includes a leader portion,formed of the thermal ribbon, that extends from an outer convolution of the roll of thermal ribbon with a leading end portion of the leader portion being attached to the take-up ribbon core and a double sided tape being attached to the leader portion so as to adhesively couple the leader portion to the outer convolution of the roll and wherein the adhesive coupling is sufficiently strong so as to prevent unraveling of the thermal ribbon from the roll on the supply core when the take-up core is supported by an operator and the supply core, with the complete roll of ribbon thereon except for the leader portion, is allowed to dangle freely.

14. The method of claim 13 and wherein the double sided tape is located relative to the leader portion at a location from a leading end of the leader portion so that when the supply core and take-up core are mounted on the cassette assembly with the thermal ribbon wound about the cassette assembly and the cassette assembly is supported in the printer apparatus the double sided tape is positioned downstream of a print nip where the printer would engage the thermal ribbon so that the double sided tape does not engage receiver media during printing.

15. For use in the method of claim 6 a thermal ribbon supply and take-up for loading into a cassette assembly of a thermal printer apparatus, the ribbon supply and take-up comprising:

a supply core having a supply of thermal ribbon wound thereon as a roll and a take-up core,wherein the thermal ribbon includes a leader portion,formed of the thermal ribbon, that extends from an outer convolution of the roll of thermal ribbon with a leading end portion of the leader portion being attached to the take-up ribbon core and a double sided tape being attached to the leader portion so as to adhesively couple the leader portion to the outer convolution of the roll and wherein the adhesive coupling is sufficiently strong so as to prevent unraveling of the thermal ribbon from the roll on the supply core when the take-up core is supported by an operator and the supply core, with the complete roll of ribbon thereon except for the leader portion, is allowed to dangle freely.

16. The ribbon supply and take-up of claim 15 and further comprising:

wherein the double sided tape is located relative to the leader portion at a location from a leading end of the leader portion so that when the supply core and take-up core are mounted on the cassette assembly with the thermal ribbon wound about the cassette assembly and the cassette assembly is supported in the printer apparatus the double sided tape is positioned downstream of a print nip where the printer would engage the thermal ribbon so that the double sided tape does not engage receiver media during printing.

* * * * *